US009533500B2

(12) United States Patent
Terada

(10) Patent No.: US 9,533,500 B2
(45) Date of Patent: Jan. 3, 2017

(54) RECORDING APPARATUS, AND METHOD OF ADJUSTING POSITION OF RECORDING UNIT IN RECORDING APPARATUS

(71) Applicant: Kohei Terada, Kiyosu (JP)

(72) Inventor: Kohei Terada, Kiyosu (JP)

(73) Assignee: Brother Kogyo Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 14/190,201

(22) Filed: Feb. 26, 2014

(65) Prior Publication Data

US 2014/0292848 A1 Oct. 2, 2014

(30) Foreign Application Priority Data

Mar. 28, 2013 (JP) ..... 2013-068138

(51) Int. Cl.

| | |
|---|---|
| ***B41J 25/304*** | (2006.01) |
| ***B41J 2/07*** | (2006.01) |
| ***B41J 13/30*** | (2006.01) |
| ***B41J 29/38*** | (2006.01) |

(52) U.S. Cl.
CPC *B41J 2/07* (2013.01); *B41J 13/30* (2013.01); *B41J 29/38* (2013.01)

(58) Field of Classification Search
USPC ..... 347/37, 49
See application file for complete search history.

(56) References Cited

U.S. PATENT DOCUMENTS 5,359,357 A * 10/1994 Takagi ..... B41J 25/34 347/49
5,872,579 A * 2/1999 Handa ..... B41J 25/308 347/8
6,059,392 A * 5/2000 Park ..... B41J 25/3086 347/8
6,270,184 B1 * 8/2001 Igarashi et al. ..... 347/37
6,536,870 B1 * 3/2003 Takahashi ..... B41J 29/393 347/49
6,644,765 B2 * 11/2003 Lim ..... B41J 25/304 347/37

(Continued)

FOREIGN PATENT DOCUMENTS

JP 2002-273868 9/2002
JP 2002-273869 9/2002

(Continued)

*Primary Examiner* — Matthew Luu
*Assistant Examiner* — Lily Kemathe
(74) *Attorney, Agent, or Firm* — Frommer Lawrence & Haug LLP

(57) ABSTRACT

A recording apparatus according to a first aspect of the invention comprises a recording unit, a first adjuster, and a second adjuster. The recording unit is configured to record an image on a recording medium, and includes an opposing face to face the recording medium at a time of recording an image on the recording medium. The first adjuster is configured to rotate a first position and a second position different from the first position, about a first axis perpendicular to the opposing face. The first and second positions are defined on the recording unit. The second adjuster is configured to rotate the first position and the second position about a second axis, different from the first axis, perpendicular to the opposing face.

19 Claims, 7 Drawing Sheets

(56) References Cited

U.S. PATENT DOCUMENTS

| | | | | |
|---|---|---|---|---|
| 7,036,896 | B2 * | 5/2006 | Kim | B41J 25/308 347/101 |
| 7,270,387 | B2 * | 9/2007 | Ueda | B41J 2/145 347/37 |
| 7,427,116 | B2 * | 9/2008 | Nakamura | B41J 25/308 347/22 |
| 8,205,881 | B2 * | 6/2012 | Terada | 271/265.01 |
| 8,287,065 | B2 * | 10/2012 | Okazawa | B41J 25/308 347/5 |
| 8,414,105 | B2 * | 4/2013 | Komuro | B41J 23/025 347/37 |
| 8,573,724 | B2 * | 11/2013 | Okazawa et al. | 347/8 |
| 8,628,171 | B2 * | 1/2014 | Terada | 347/37 |
| 8,905,505 | B2 * | 12/2014 | Kakigahara | B41J 11/20 347/8 |
| 2002/0105688 | A1 | 8/2002 | Katagami et al. | |
| 2005/0196214 | A1 * | 9/2005 | Ishikawa et al. | 400/352 |
| 2009/0244124 | A1 | 10/2009 | Kondo | |
| 2011/0109696 | A1 * | 5/2011 | Essen | B41J 25/304 347/49 |
| 2011/0141192 | A1 * | 6/2011 | Komuro | B41J 23/025 347/37 |
| 2012/0044310 | A1 * | 2/2012 | Yajima | B41J 2/1752 347/104 |
| 2013/0070020 | A1 * | 3/2013 | Terada | 347/37 |

FOREIGN PATENT DOCUMENTS

| | | |
|---|---|---|
| JP | 2005-224723 | 8/2005 |
| JP | 2007-276427 | 10/2007 |
| JP | 2009-262540 | 11/2009 |

* cited by examiner

RECORDING APPARATUS, AND METHOD OF ADJUSTING POSITION OF RECORDING UNIT IN RECORDING APPARATUS

CROSS REFERENCE TO RELATED APPLICATION

This application claims priority from Japanese Patent Application No. 2013-068138, which was filed on Mar. 28, 2013, the disclosure of which is herein incorporated by reference in its entirety.

BACKGROUND OF THE INVENTION

1. Field of the Invention

The present invention relates to a recording apparatus configured to record an image to a recording medium, and a method of adjusting the position of a recording unit in the recording apparatus.

2. Description of Related Art

Regarding a method of adjusting the position of a recording unit in the recording apparatus, there has been known a technology which adjusts the position of the recording unit by individually performing a process of moving the recording unit in a direction about an axis (hereinafter, "rotational direction") perpendicular to an opposing face of the unit and a process of moving of the same in a direction parallel to the opposing face (hereinafter, "parallel direction").

SUMMARY OF THE INVENTION

However, in order to accurately adjust the position with the structure which individually performs the process of moving the recording unit in the rotational direction and the process of moving the same in the parallel direction, the movement in the rotational direction and the movement in the parallel direction need to be independent of each other. In other words, at least one of the following requirements needs to be met: movement in the rotational direction does not cause movement in the parallel direction; and movement in the parallel direction does not cause the movement in the rotational direction. Restricting the movement of the recording unit in the rotational direction while moving the same in the parallel direction necessitates a large-scale mechanism, because the entire mechanism for moving the recording unit in the rotational direction needs to be moved in the parallel direction. The same applies when moving, in the rotational direction, the entire mechanism for moving the recording unit in the parallel direction, and a large-scale mechanism will be necessary.

Further, in order to accurately adjust the position with the structure which individually performs the process of moving the recording unit in the rotational direction and the process of moving the same in the parallel direction, one of the movements in the rotational direction and in the parallel direction need to be adjusted after the other one of the movements, affecting the one of the movements, is adjusted. In other words, test recording is first conducted to determine a target travel amount (where "target travel amount" means an amount by which an object is moved (i.e., a distance between the current position and a target position where the object should be disposed). The same definition applies to the rest of the description hereinbelow) in the rotational direction, and then recording unit is moved in the rotational direction, after which another test recording is conducted to determine the target travel amount in the parallel direction and moving the recording unit in the parallel direction.

Alternatively, the test recording is conducted to determine the target travel amount in the parallel direction, and then the recording unit is moved in the parallel direction, after which another test recording is conducted to determine the target travel amount in the rotational direction, and then the recording unit is moved in the rotational direction. In either cases, a complex It is therefore an object of the present invention to provide a recording apparatus capable of accurate position adjustment with a simple process and structure, and to provide a method of adjusting the position of a recording unit in the recording apparatus.

A recording apparatus according to a first aspect of the invention comprises a recording unit, a first adjuster, and a second adjuster. The recording unit is configured to record an image on a recording medium, and includes an opposing face to face the recording medium at a time of recording an image on the recording medium. The first adjuster is configured to rotate a first position and a second position different from the first position, about a first axis perpendicular to the opposing face. The first and second positions are defined on the recording unit. The second adjuster is configured to rotate the first position and the second position about a second axis, different from the first axis, perpendicular to the opposing face.

A method of adjusting a position of a recording unit in a recording apparatus according to a second aspect of the invention comprises first to fourth processes. The recording apparatus includes a recording unit, a first adjuster, and a second adjuster. The recording unit is configured to record an image on a recording medium, and includes an opposing face to face the recording medium at a time of recording an image on the recording medium. The first adjuster is configured to rotate a first position and a second position different from the first position, about a first axis perpendicular to the opposing face. The first and second positions are defined on the recording unit. The second adjuster is configured to rotate the first position and the second position about a second axis, different from the first axis, perpendicular to the opposing face. The first process is of measuring a relative position which is a position of the recording unit relative to a position where the recording unit should be disposed in the recording apparatus. The second process is of after the first process, determining a target travel amount relative to a direction parallel to the opposing face of the recording unit, based on the relative position measured in the first process. The third process is of after the first process, determining a first operation quantity which is an operation quantity of the first adjuster, and a second operation quantity which is an operation quantity of the second adjuster, based on the target travel amount determined in the second process. The fourth process is of, after the third process, operating the first adjuster and the second adjuster based on the first operation quantity and the second operation quantity, to cause the recording unit to move in the direction parallel to the opposing face by the target travel amount.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

The following describes a preferable embodiment of the present invention with reference to the attached drawings.

Figure 1:
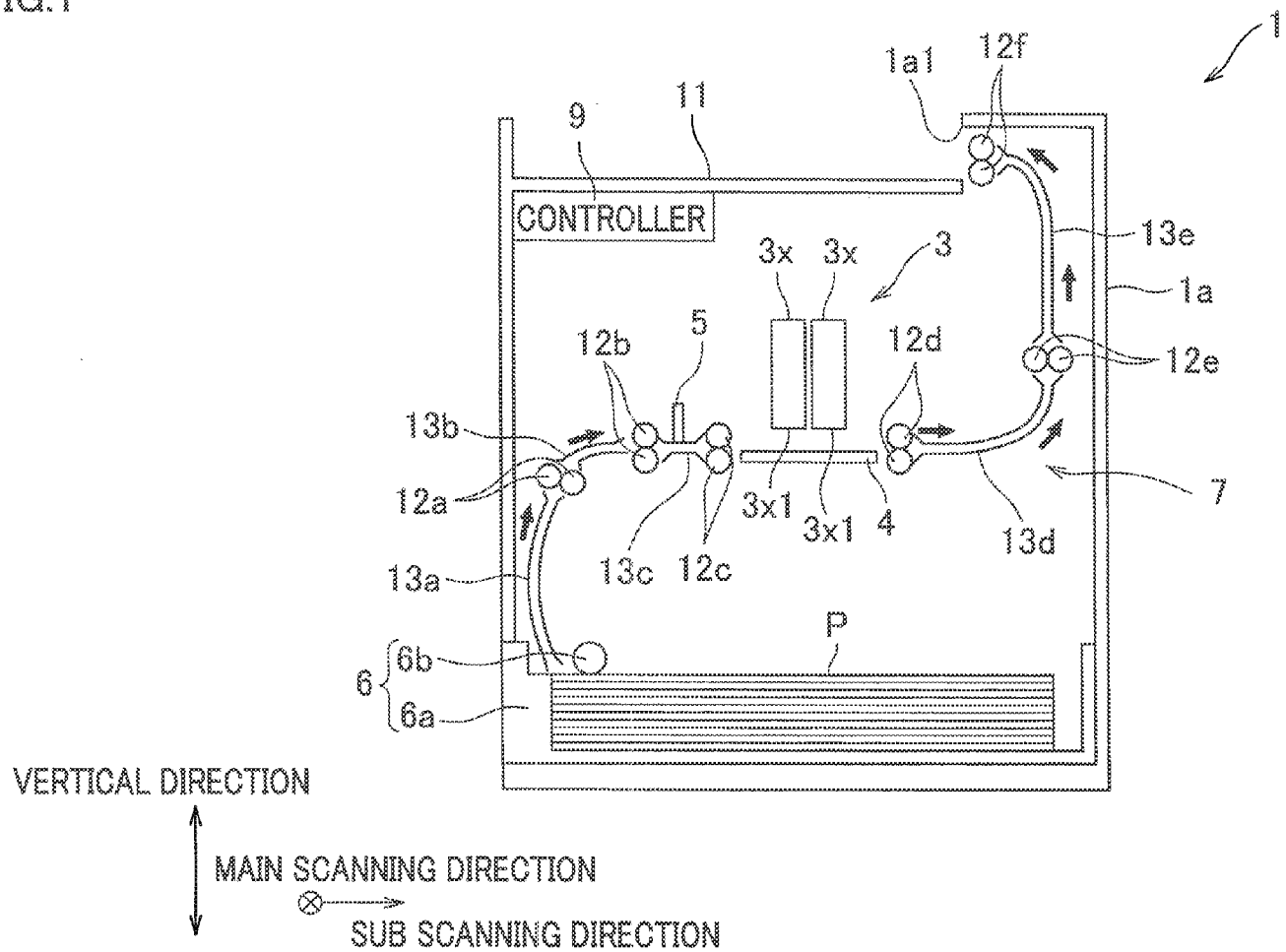
FIG. 1 is a schematic side view showing the inside of an ink-jet printer related to an embodiment of the present invention.

First, with reference to FIG. 1, an overall structure of an inkjet printer 1 related to one embodiment of the present invention is described.

The printer 1 includes a casing 1*a* having a rectangular parallelepiped shape. In a top part of the top plate of the casing 1*a* is provided a sheet output unit 11. The casing 1*a* accommodates therein an inkjet head 3, a platen 4, a sheet sensor 5, a sheet-feeder unit 6, a conveyance unit 7, and a controller 9, and the like. Further, in the inside space of the casing 1*a*, there is a conveyance path through which a sheet P as an example of the recording medium of the invention is conveyed from the sheet-feeder unit 6 to the sheet output unit 11 in a direction indicated by the bold arrow of FIG. 1.

Figure 2:
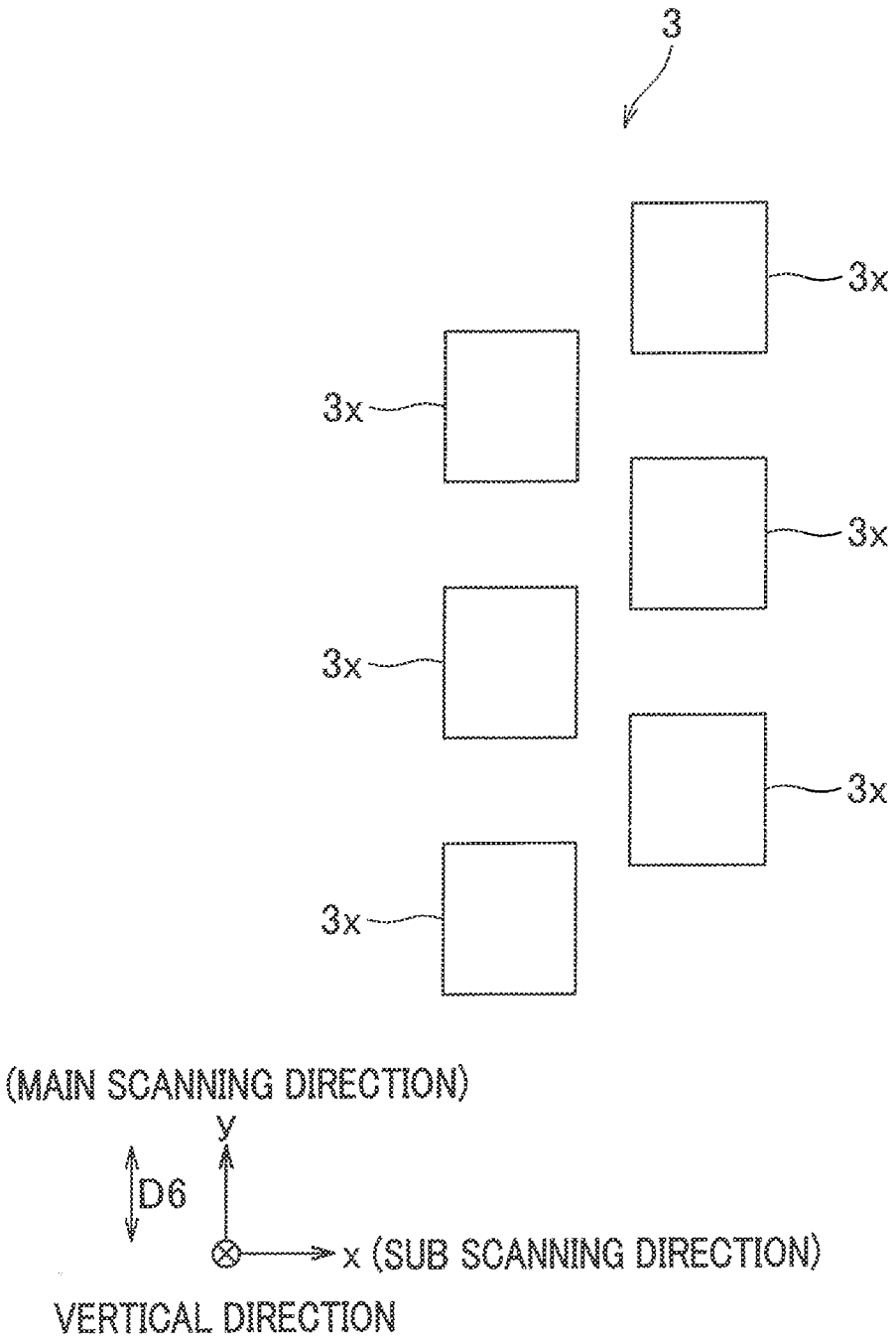
FIG. 2 is a plan view showing a structure of an ink-jet head of the printer shown in FIG. 1.

The head 3 includes six head units 3*x* which are examples of the recording units of the present invention. The head units 3*x* are apart from each other and aligned in a main scanning direction, in a zigzag manner (see FIG. 2). A direction in which the head units 3*x* are arranged (sixth direction D6) is parallel to an opposing face 3*x*1 of each head unit 3*x* (see FIG. 1: the surface to face the sheet P at a time of recording), and perpendicularly crosses a direction (sub scanning direction) in which the head unit 3*x* and sheet P move relatively to each other at the time of recording. In the present embodiment, the sixth direction D6 is the main scanning direction (a direction parallel to the opposing face 3*x*1 and perpendicularly crossing the directions of the relative movement: lateral direction of the sheet). The printer 1 is a line type printer which performs recording while its head units 3*x* are fixed. The six head units 3*x* each has the same structure, and includes a passage member, an energy applier, and a driver IC 47 (see FIG. 4). In the passage member are formed passages leading to ejection openings 30 (see FIG. 3A and FIG. 3B). The energy applier is configured to apply to the ink inside the passages energy for ejection of the ink from the ejection openings 30. The present embodiment adopts a piezoelectric energy applier (piezoelectric actuator) using a piezoelectric element. The piezoelectric actuator is connected to the controller 9 via a wiring member (e.g., flexible printed circuit board: FPC) having a driver IC 47 mounted thereon. Under control of the controller 9, a predetermined electric potential is given from the driver IC 47 to drive the piezoelectric actuator.

The platen 4 is a member in the form of a flat plate. The platen 4 faces the six head units 3*x* in the vertical direction. The vertical direction is perpendicularly crossing the main scanning direction and the sub scanning direction. Between the top surface of the platen 4 and the opposing face 3*x*1 of each of the head units 3*x* is a predetermined gap suitable for recording (image formation).

The sheet sensor 5 is disposed upstream of the head 3, relative to a direction of conveying the sheet P by the conveyance unit 7 (hereinafter, simply referred to as "conveyance direction"). The sheet sensor 5 detects the leading end of the sheet P and transmits a detection signal to the controller 9.

The sheet-feeder unit 6 includes a sheet-feeder tray 6*a* and a sheet-feeding roller 6*b*. The sheet-feeder tray 6*a* is detachable with respect to the casing 1*a*. The sheet-feeder tray 6*a* is a box with its top surface being opened, and is capable of accommodating a plurality of sheets R Driving the sheet-feeding motor 6M (see FIG. 4) under control of the controller 9 rotates the sheet-feeding roller 6*b*, thus feeding the uppermost one of the sheets P from the sheet-feeder tray 6*a*.

The conveyance unit 7 includes pairs of rollers 12*a*, 12*b*, 12*c*, 12*d*, 12*e*, and 12*f*, and guides 13*a*, 13*b*, 13*c*, 13*d*, and 13*e*. The roller pairs 12*a* to 12*f* are disposed along the conveyance path, sequentially in this order from the upstream relative to the conveyance direction. One roller out of each roller pairs 12*a* to 12*f* is a drive roller rotated by driving the conveyance motor 7M (see FIG. 4) under control of the controller 9. The other one of each pair is a driven roller which rotates with rotation of the corresponding drive roller. The guides 13*a* to 13*e* disposed along the conveyance path, sequentially from the upstream relative to the conveyance direction, are alternated with the roller pairs 12*a* to 12*f*. Each of the guides 13*a* to 13*e* is made of a pair of plates disposed to face each other.

Under the control by the controller 9, the sheet P feeded from the sheet-feeder unit 6 is sandwiched by the roller pairs 12*a* to 12*f* and conveyed in the conveyance direction, through the space between the plates of the guides 13*a* to 13*e*. When the sheet P passes immediately under each head unit 3*x* while being supported by the top surface of the platen 4, ink is ejected from a plurality of ejection openings 30 (see FIG. 3A and FIG. 3B) formed on the opposing face 3*x*1 of each head unit 3*x* towards the surface of the sheet P, under control of the controller 9. The ink ejection is performed from the ejection openings 30 based on the detection signals transmitted from the sheet sensor 5. The sheet P on which an image is formed is discharged to the sheet output unit 11 from an opening 1*a*1 formed at a top part of the casing 1*a*.

Figure 4:
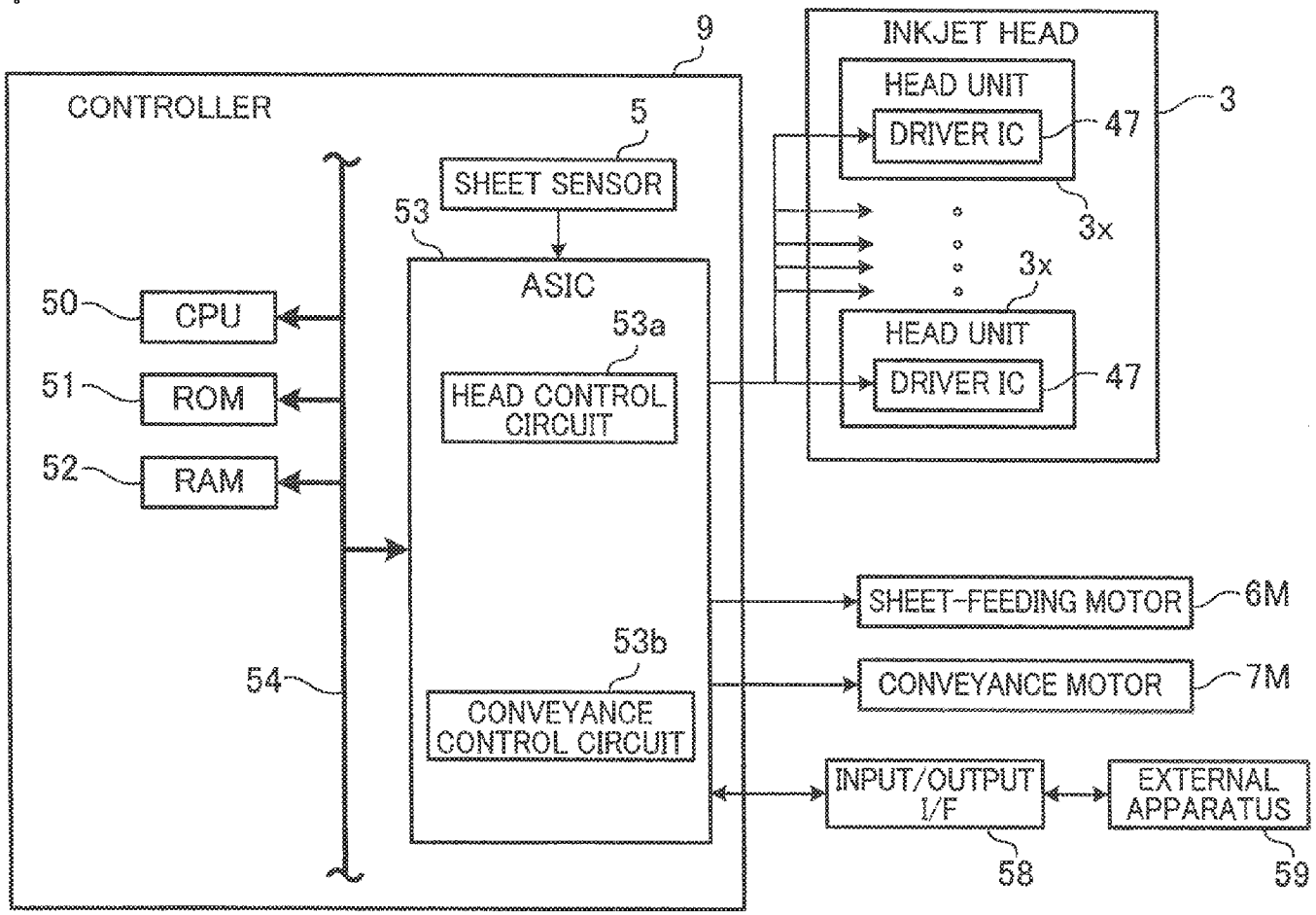
FIG. 4 is a block diagram showing electric structure of the printer shown in FIG. 1.

As shown in FIG. 4, the controller 9 includes a CPU (Central Processing Unit) 50, a ROM (Read Only Memory) 51, a RAM (Random Access Memory) 52, an ASIC (Application Specific Integrated Circuit) 53, a path 54, and the like. The ROM 51 stores therein a program run by the CPU 50, various fixed data, and the like. The RAM 52 temporarily stores data needed at a time of running the program (image data or the like). The ASIC 53 includes a head control circuit 53*a* and a conveyance control circuit 53*b*. Further, the ASIC 53 is connected to and in communication with an external apparatus 59 such as a PC (Personal Computer) through an input/output I/F (Interface) 58. The head control circuit 53*a* controls the driver IC 47 based on record data input from the external apparatus 59. The conveyance control circuit 53*b* controls the sheet-feeding motor 6M and the conveyance motor 7M based on the record data input from the external apparatus 59.

Figure 3B:
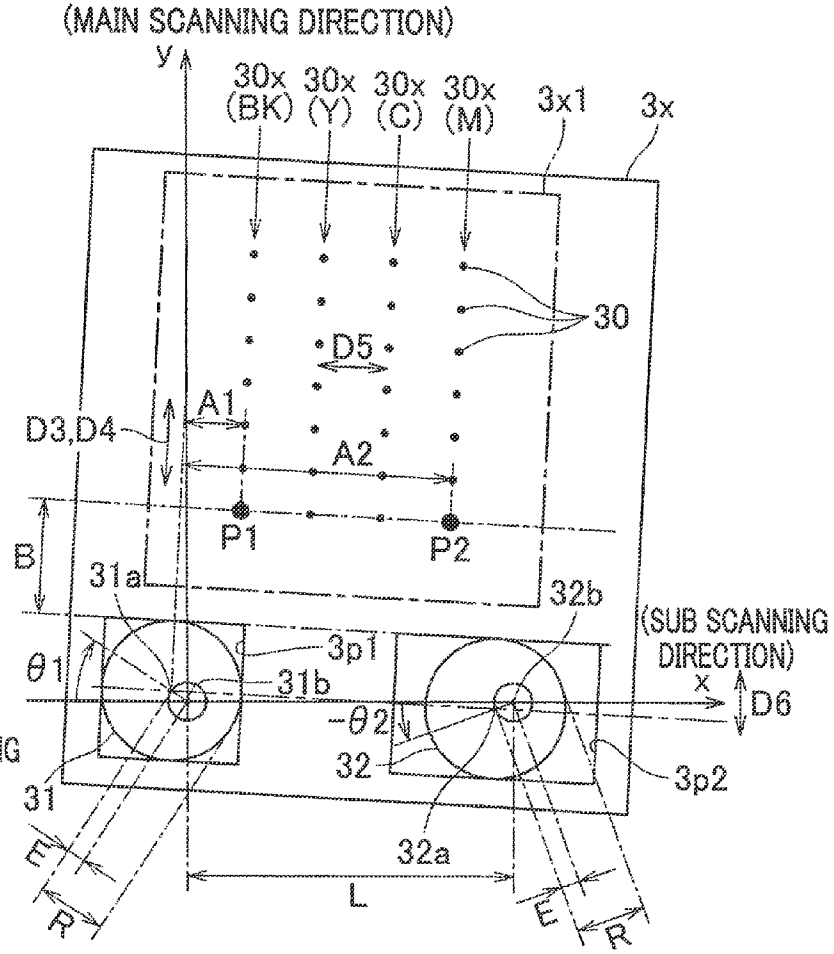
FIG. 3B is a schematic plan view of a position adjusting mechanism for the head unit after adjustment.
Figure 3A:
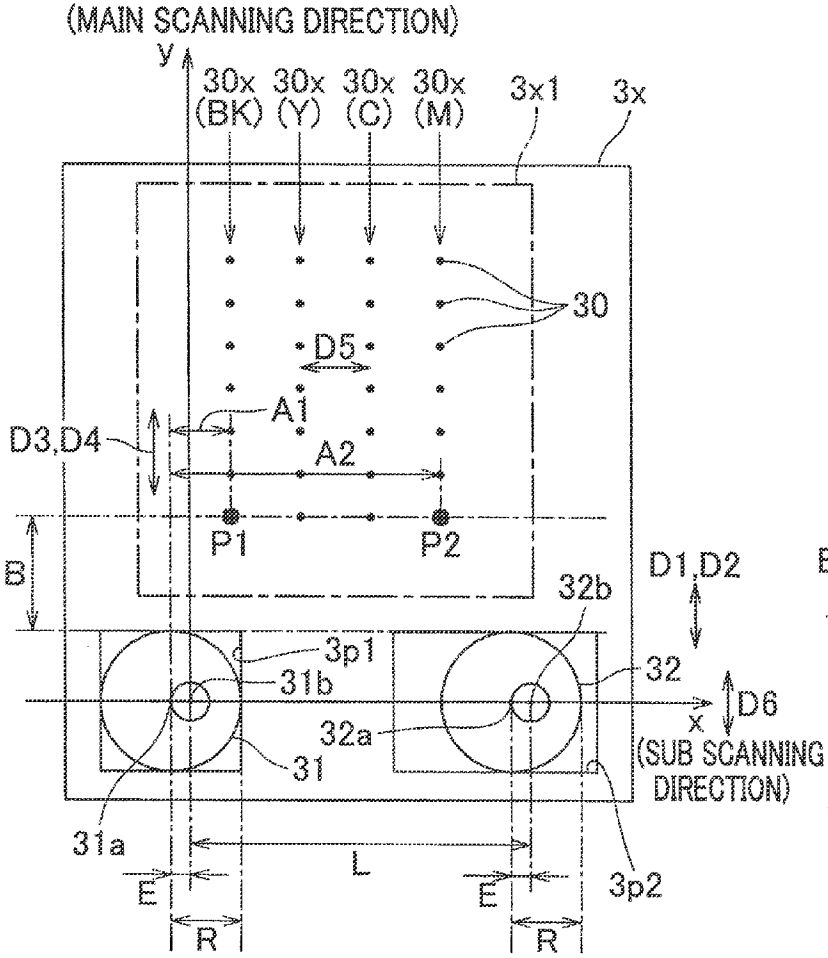
FIG. 3A is a schematic plan view showing a position adjusting mechanism for a head unit before adjustment.

Next, with reference to FIG. 3A and FIG. 3B, the following describes how the ejection openings 30 are disposed on each head unit 3*x*, and a position adjusting mechanism of the head unit 3*x*. Note that the ejection openings 30 are disposed in the same way for all of the six head units 3*x*, and the structure of the position adjusting mechanism is also the same for the head units 3$x$. Therefore, FIG. 3A and FIG. 3B shows a single head unit 3$x$ and a position adjusting mechanism provided related to that head unit 3$x$.

The ejection openings 30 on the opposing face 3$x$1 are aligned in the fourth direction D4 at predetermined intervals, and form four ejection opening arrays 30$x$ corresponding to ink of Black (BK), Yellow (Y), Cyan (C), and Magenta (M), respectively. The four ejection opening arrays 30$x$ are aligned in a fifth direction D5 which is parallel to the opposing face 3$x$1 and perpendicularly crosses the fourth direction D4, at predetermined intervals.

The position adjusting mechanism includes a first cam 31 as an example of the first adjuster of the invention and a second cam 32 as an example of the second adjuster of the invention. The cams 31 and 32 have structures and the sizes which are identical to each other. The cams 31 and 32 are disposed in such a manner as to sandwich therebetween the four ejection opening arrays 30$x$ relative to the fifth direction D5. The cams 31 and 32 are provided through holes 3$p$1 and 3$p$2 formed on the head unit 3$x$, and are structured to rotate with their circumferential surfaces being in contact with the surfaces defining the through boles 3$p$1 and 3$p$2 of the head unit 3$x$, respectively. The cams 31 and 32 have rotation centers 31$b$ and 32$b$ which deviate from the centers 31$a$ and 32$a$ by a distance F, respectively. The rotation center 31$b$ is an example of the second axis of the invention. The rotation center 32$b$ is an example of the first axis of the invention. Shafts serving as the rotation centers 31$b$ and 32$b$ extend in a direction perpendicularly crossing the opposing face 3$x$1, and are supported by the casing 1$a$. The through hole 30, when viewed from the vertical direction, has a square shape with each side having substantially the same length as the diameter of the first cam 31. The through hole 3$p$2 on the other hand has a rectangular shape with two sides having substantially the same length as the diameter of the second cam 32 extended in the fourth direction D4, and with two sides longer than the diameter of the second cam 32 extended in the fifth direction D5, when viewed from the vertical direction. Therefore, while the movement of the first cam 31 is restricted in both the fourth direction D4 and the fifth direction D5, the movement of the second cam 32 is restricted to the fourth direction D4, but not in the fifth direction D5, and is free relative to the fifth direction D5. The cams 31 and 32 are coupled with not-shown gears and not-shown arms, respectively, and each teeth of the gears rotates the corresponding cam by a predetermined angle. The gears also serve as a lock, and fixing the gear inhibits rotation of the corresponding one of the cams 31 and 32.

A first position P1 and a second position P2 are any given positions designated on the head unit 3$x$. In this embodiment, the centers of the ejection openings 30 in the ejection opening arrays 30$x$ corresponding to Black (BK) and Magenta (M), which are positioned closest to the cams 31 and 32 relative to the fourth direction D4 are the first position P1 and the second position P2, respectively. From the state shown in FIG. 3A, the cams 31 and 32 are assumed to be brought into the state shown in FIG. 3B, by rotating them clockwise by θ1 and −θ2, respectively. In this case, the amounts of travelling of the positions P1 and P2 relative to the main scanning direction are derived by the following Equation 1.

$$\begin{pmatrix} \Delta y1 \\ \Delta y2 \end{pmatrix} = \frac{E}{L}\begin{pmatrix} L-A1 & -A1 \\ L-A2 & -A2 \end{pmatrix}\begin{pmatrix} \Delta\sin\theta1 \\ \Delta\sin\theta2 \end{pmatrix} \qquad \text{Equation 1}$$

Definitions of each symbol in the above Equation 1 are as follows.

Δy1: the amount of travelling of the first position P1 relative to the main scanning direction Δy2: the amount of travelling of the second position P2 relative to the main scanning direction E: distance by which the cams 31 and 32 are deviated R: radii of cams 31 and 32

L: distance between the rotation centers of the cams 31 and 32

B: intervals between the positions P1 and P2 and the cams 31 and 32, relative to the fourth direction D4

A1: interval between the first position P1 and the center 31$a$, relative to the fifth direction D5

A2: interval between the second position P2 and the center 31$a$, relative to the fifth direction D5

Δ sin θ1: the amount of variation of sin θ1 caused by varying θ1

Δ sin θ2: the amount of variation of sin θ2 caused by varying θ2

With rotation of the cams 31 and 32 about the rotation centers 31$b$ and 32$b$, the positions P1 and P2 rotate. The first cam 31 rotates the positions P1 and P2 about the rotation center 32$b$, and the second cam rotates the positions P1 and P2 about the rotation center 31$b$. This way the position of each head unit 3$x$ is adjustable. That is, with rotation of the positions P1 and P2 by the cams 31 and 32, the position of the head unit 3$x$ is adjustable relative to travel including a component of travel in a direction perpendicularly crossing the opposing face 3$x$1 (hereinafter, "rotational direction") and a component of travel in the fourth direction D4. Note that Δy1 and Δy2 are determined by both Δθ1 and Δθ2.

Where the direction perpendicularly crossing a line connecting the first position P1 and the second position P2 is third direction D3, the amount of travelling of the first position P1 by the first cam 31 in the third direction D3 is a, the amount of travelling of the second position P2 by the first cam 31 in the third direction D3 is b, the amount of travelling of the first position P1 by the second cam 32 in the third direction D3 is c, and the amount of travelling of the second position P2 by the second cam 32 in the third direction D3 is d, ad−bc≠0 (that is, there exists an inverse matrix (Equation 2 below) which is the inverse of the matrix of the above Equation 1). Note that Δθ1 and Δθ2 are determined by both Δy1 and Δy2.

$$\begin{pmatrix} \Delta\sin\theta1 \\ \Delta\sin\theta2 \end{pmatrix} = \frac{1}{E(A2-A1)}\begin{pmatrix} A2 & -A1 \\ L-A2 & -L+A1 \end{pmatrix}\begin{pmatrix} \Delta y1 \\ \Delta y2 \end{pmatrix} \qquad \text{Equation 2}$$

The first direction D1 which is a direction corresponding to the line tangent to rotation about the rotation center 32$b$ at the first position P1, and the second direction D2 which is the direction corresponding to the line tangent to rotation about the rotation center 31$b$ at the second position P2 both include a component of fourth direction D4. The third direction D3 is the same direction as the sixth direction D6 (main scanning direction) before the position adjustment.

The first direction D1 and the second direction D2 are both preferably a direction close to the fourth direction D4 (substantially the same direction). Further, the first direction D1 and the second direction D2 are preferably a direction close to each other (substantially the same direction).

The closer the first direction D1 and the second direction D2 are to each other, the better the approximate accuracy of Equation 1. In other words, a difference between θ1 and θ2 determined based on the approximation equation assuming that the first direction D1 and the second direction D2 are the same direction and the rotation amounts θ1 and θ2 determined based on an exact formula is reduced, and the accuracy of the position adjustment is improved. Further, the closer the first direction D1 and the second direction D2 are, the greater the amount of travelling of the head unit 3*x* for the sizes of the cams 31 and 32. Therefore, with the first direction D1 and the second direction D2 being close to each other, downsizing of the printer 1 and highly accurate position adjustment become possible.

Note that, of the main scanning direction, the sub scanning direction, and the first to sixth directions D1 to D6, the main scanning direction and the sub scanning direction, and the sixth direction D6 are each a direction fixed with respect to the casing 1*a*, and is not varied when the head unit 3*x* rotates. To the contrary, the first direction D1 to fifth direction D5 are each a direction defined relative to the individual head units 3*x*, and are varied by rotation of the head unit 3*x*. In the present embodiment, D3=D4=D6=the main scanning direction, and D5=the sub scanning direction before the position adjustment (see FIG. 3A).

Figure 5:
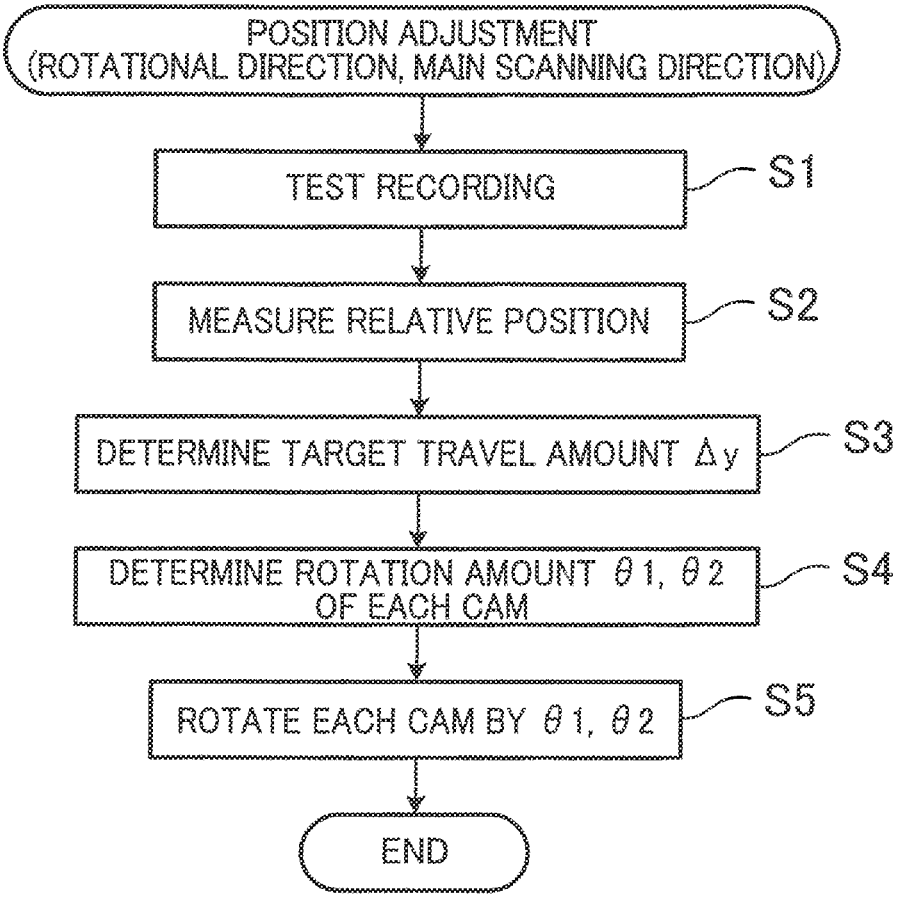
FIG. 5 is a flow chart showing a position adjustment method for the printer shown in FIG. 1.
Figure 6:
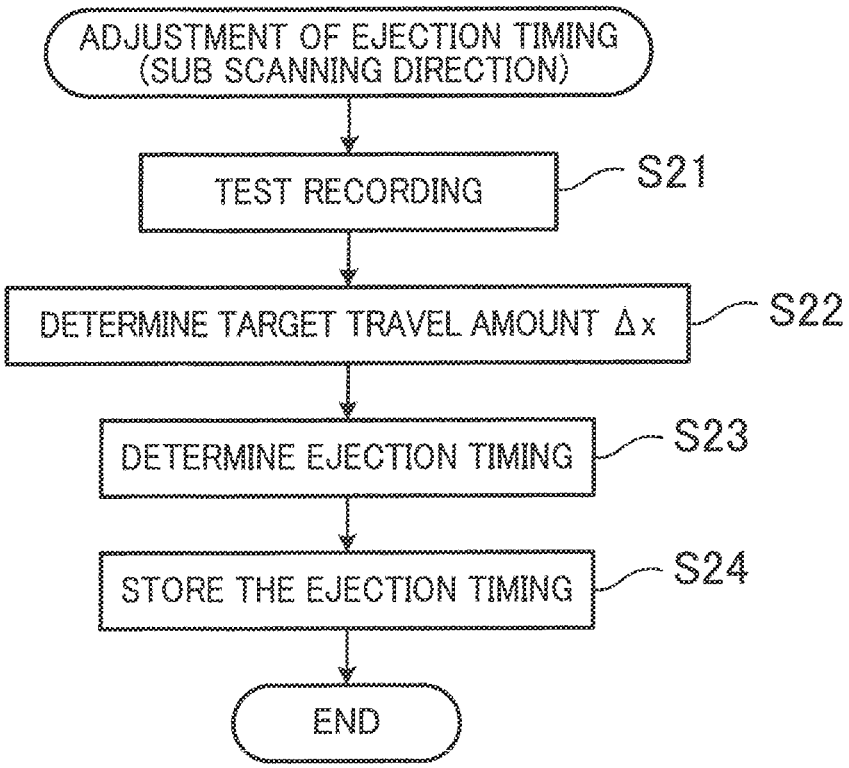
FIG. 6 is a flow chart showing an ejection timing adjustment method for the printer shown in FIG. 1.

Next, with reference to FIG. 5 and FIG. 6, the following describes a position adjustment method and an ejection timing adjustment method for the head unit 3*x*.

The position adjustment is performed, for example, after each components of the printer 1 are assembled in the manufacturing process of the printer 1, before shipping of the printer 1 from the plant. The adjustment of ejection timing is performed after the position adjustment. Further, the position adjustment is performed relative to the rotational direction and the main scanning direction, and the adjustment of ejection timing is performed relative to the sub scanning direction.

In the position adjustment, test recording is first performed as shown in FIG. 5 (S1). Specifically, for each of the six head units 3*x*, ink is ejected from the ejection openings 30 corresponding to Black (BK) and Magenta (M) to perform recording on a test sheet P, and then the image recorded is read by using a scanner.

After S1, measurement is conducted as to a relative position (S2: first process). The relative position is a position of the head unit 3*x* relative to a position where the head unit 3*x* should be disposed in the printer 1. Specifically, based on the results of S1, the relative position is measured for each of the six head units 3*x*, from intervals relative to the main scanning direction between the landing position, on the sheet P, of the ink droplets ejected from the ejection openings 30 of one head unit 3*x*, and the landing position, on the sheet P, of the ink droplets ejected from the ejection openings 30 of another head unit 3*x* adjacent to the one head unit 3*x* relative to the main scanning direction.

After S2, Δy (target travel amount of the head unit 3*x* relative to the main scanning direction) is determined (S3: second process). Specifically, for each of the six head units 3*x*, Δy is determined based on the relative position measured in S2. By the "target travel amount", it means an amount by which an object should travel (that is, an amount of travelling from the current position to a position where the object should be disposed).

After S3, the rotation amounts Δθ1 and Δθ2 of the cams 31 and 32 are determined (S4: third process). The rotation amount is an example of the operation quantity of the present invention. Δθ1 is an example of the first operation quantity of the present invention, and Δθ2 is an example of the second operation quantity of the present invention. Specifically, for each of the six head units 3*x*, Δ sin θ1 and Δ sin θ2 are derived, based on Δy determined in S3 and the above Equation 2, and rotation amounts Δθ1 and Δθ2 that result in such sines are determined. Note that the θ1 and θ2 are rotation amounts of the cams 31 and 32 with the sub scanning direction as the reference, and the Δθ1 and Δθ2 are variation in θ1 and θ2 of the cams 31 and 32 before and after movement in the position adjustment. In the present embodiment, θ1=0, and θ2=0 before the position adjustment. Therefore, θ1=Δθ1 and θ2=Δθ1.

After S4, the cams 31 and 32 are rotated clockwise by Δθ1 and Δθ2 (S5: fourth process). Specifically; for each of the six head units 3*x*, the arm is operated to rotate the gear by the number of tooth corresponding to the Δθ1 and Δθ2. This causes the positions P1 and P2 of each of the six head units 3*x* to move in the main scanning direction by Δy1 and Δy2. At this time, the six head units 3*x* may be moved at the same time or separately.

Note that, in the present embodiment, the rotation amounts θ1 and θ2 of the cams 31 and 32 are angles from the sub scanning direction (see FIG. 3B). The rotation amounts of the cams 31 and 32 for the head unit 3*x* are, in a precise mathematical sense, angles from a direction (the direction indicated by the single dotted line in FIG. 3B) connecting the centers 31*a* and 32*a*, and are slightly different from the θ1 and θ2 of the present embodiment; i.e., an amount resulting from subtraction of the entire rotation amount of the head unit 3*x* from θ1 and θ2 of the present embodiment. However, if a deviation distance E is sufficiently smaller than the distance between the rotation centers 31*b* and 32*b*, such a difference in Δθ1 and Δθ2 can be practically counted out.

Through the above processes, position adjustment is performed for each head unit 3*x*, relative to the rotational direction and the main scanning direction.

In adjustment of eject timing, test recording is first performed as shown in FIG. 6 (S21). Specifically, a pattern different from that used in S1 is used in the process similar to S1.

After S21, Δx (target travel amount of the landing position relative to the sub scanning direction) is determined (S22). Specifically, for each of the six head units 3*x*, based on the result of S21, Δx is determined, from intervals between landing position, on the sheet P, of the ink droplets ejected from the ejection openings 30 of one head unit 3*x* and the landing position, on the sheet P, of the ink droplets ejected from the ejection openings 30 of another head unit 3*x* adjacent to the one head unit 3*x* relative to the sub scanning direction, and from the distance from the landing position, on the sheet P, of the ink droplets ejected from the ejection openings 30 of the head unit 3*x* to an end of the sheet P relative to the sub scanning direction, and the like.

After S22, ink ejection timing from the ejection openings 30 is determined (S23). Specifically, ejection timing of ink is determined for each of the ejection openings 30 based on Δx determined in S22, and position information of the ejection opening 30 related to the fifth direction D5.

After S23, data related to the ejection timing determined in S23 is stored in the ROM 51, using a controller or the like of the manufacturing apparatus (S24). The controller 9 controls the ejection timing of the ink from the ejection openings 30 based on the data stored in the ROM 51, at a time of recording.

As hereinabove described, instead of individually performing movement in the rotational direction and that in the parallel direction to adjust the position, the present embodiment adjusts the position of the head units 3*x* by using the cams 31 and 32 to rotate the first position P1 and the second position P2 about the rotation centers 31*b* and 32*b*. That is, instead of perceiving the position adjustment of the head units 3*x* as a combination of movement in the rotational direction and that in the parallel direction, the present embodiment perceives the same simply as the movement of two predetermined points. i.e., positions P1 and P2 on each of the head units 3*x*, and collectively performs adjustment relative to both the rotational directions and the parallel direction (in the present embodiment, main scanning direction). This, as compared with adjustment based on the former perception, enables accurate position adjustment with a simple process and a simple structure, and complex processes or large-scale machines are not necessary.

The first direction D1 and the second direction D2 both include a component of the sub scanning direction. This enables position adjustment relative to the lateral direction (BR) of the sheet P. To add this, it is possible to minimize the rotation amount (adjustment range) of the cams 31 and 32 for the amount of movement of the head unit 3*x* relative to the lateral direction (BR) of the sheet P. Therefore, highly accurate position adjustment of the head unit 3*x* relative to the lateral direction (BR) of the sheet P is possible.

The printer 1 is structured so that $ad-b\neq 0$, where the direction perpendicularly crossing a line connecting the first position P1 and the second position P2 is third direction D3, the amount of travelling of the first position P1 by the first cam 31 in the third direction D3 is a, the amount of travelling of the second position P2 by the first cam 31 in the third direction D3 is h, the amount of travelling of the first position P1 by the second cam 32 in the third direction D3 is c, and the amount of travelling of the second position P2 by the second cam 32 in the third direction D3 is d. In this case, there will always be a combination of $\Delta\theta 1$ with $\Delta\theta$, the position of each head unit 3*x* is reliably adjustable by the cams 31 and 32.

Adjusters for rotating the positions P1 and P2 of the head unit 3*x* include the cams 31 and 32 each of which rotates about an axis perpendicularly crossing the opposing face 3*x*1. It is therefore possible to realize highly accurate adjusters having little play, with a simple structure.

Further, the structures and the sizes of the cams 31 and 32 of the present embodiment are the same. The rotation amounts of the cams 31 and 32 are therefore determined with a more simple equation. To add this, since the identical components are used for the cams 31 and 32, it is possible to manufacture the printer 1 at a low cost.

Further, in the present embodiment, the rotation center 31*b* of the cam 31 corresponds to the axis of rotation of the cam 32, and the rotation center 32*b* of the cam 32 corresponds to the axis of rotation of the cam 31. The rotation center of the cam of one of the adjusters serves as an axis for the rotation of the entire printer 1 by means of the other adjuster. Therefore, unlike a case of separately providing a rotation center of a cam and the axis of rotation caused by an adjuster, each adjuster is realized with a simple structure.

The first direction D1 and the second direction D2 both include a component of the fourth direction (direction in which the ejection opening 30 are arranged) D4. Therefore, it is suitable for an inkjet liquid ejection apparatus such as the one described in the present embodiment.

The positions of each head unit 3*x* relative to the rotational direction and the fourth direction D4 are adjustable by rotation of the positions P1 and P2 with the use of the cams 31 and 32. The controller 9 controls the ejection timing of the ink from the ejection openings 30, based on positional information of the ejection openings 30 relative to the fifth direction D5. Since adjustment of the landing position relative to the fifth direction D5 does not require position adjustment by the cams 31 and 32 and the control of the ejection timing will cover the same, it is possible to simplify the processes and the structures related to the position adjustment.

The cams 31 and 32 are disposed in such a manner as to sandwich the four ejection opening arrays 30*x* therebetween, relative to the fifth direction D5. The greater the interval between the cams 31 and 32 relative to the fifth direction D5, the better the accuracy and efficiency of the position adjustment relative to the fourth direction D4 becomes ("efficiency" here means an amount of travelling of the head unit 3*x* for the rotation amounts of the cams 31 and 32). This improves the accuracy and the efficiency of the position adjustment relative to the fourth direction D4, while restraining an increase in the size.

The first direction D1 and the second direction D2 both include a component of the sixth direction (direction in which the six head units 3*x* are arranged) D6. The cams 31 and 32 are provided to each of the six head units 3*x*. For each of the six head units 3*x*, the S1 to S5 relating to the position adjustment are performed. In this case, a head 3 long in the sixth direction D6 is structured by using a plurality of head units 3*x* short in the sixth direction D6. Although this structure necessitates adjustment of the positional relation among the head units 3*x*, the position adjusting mechanism such as the one described in the present embodiment enables accurate position adjustment with a simple process and a simple structure.

Further, in the present embodiment, the centers 31*a* and 32*a* and the rotation centers 31*b* and 32*b* of the cams 31 and 32 are aligned in one row relative to the sub scanning direction, before adjustment (see FIG. 3A). This maximizes the amount of travelling of each head unit 3*x* relative to the main scanning direction, for the rotation amounts of the cams 31 and 32.

The above position adjustment may be performed for adjusting positional relation among components other than a recording unit in a recording apparatus (e.g., a cap for covering the opposing face), and application of the above position adjustment is not limited to one performed in a recording apparatus including a plurality of recording units for adjusting positional relation among the recording units.

The above position adjustment of the recording unit may be performed, for example, by a user of the recording apparatus, and the timing of performing the adjustment is not limited to the manufacturing process of the recording apparatus.

When adjusting the ejection timing, $\Delta x$ may be determined without test recording, using the result of test recording performed in the position adjustment.

Confirmation of the result of test recording is not limited to one by means of an apparatus such as a scanner. For example, the result may be confirmed by using a microscope, or by human eyes.

In the above embodiment, an operation quantity of the adjuster is determined by using an approximation equation; however, the present invention is not limited to this. For example, the operation quantity of the adjuster may be determined by using an exact formula, or by using a table indicating an operation quantity of the adjuster and associated amount of travelling of the recording unit.

Although the first position and the second position are each set to the center of an ejection opening in the above-mentioned embodiment; however, these positions may be set to any given position other than the center of an ejection opening. In this case, a marking or the like for positioning may be given to the position.

The first adjuster and the second adjuster may be structured by a member other than a cam (e.g. screw).

The recording units do not have to be necessarily arranged in a zigzag manner, and may be arranged in one line or a in two or more lines in a non-zigzag manner. Further, the direction of arranging the recording units is not limited to the main scanning direction.

It is not necessary to provide a plurality of recording units in a recording apparatus, as long as the recording apparatus includes at least one recording unit.

The ejection openings on the opposing face may be altered in any given ways. For example, it is possible to align the openings in a single ejection opening array.

The above embodiment deals with a case where the liquid ejected from the ejection openings formed on the opposing face includes a plurality of kinds of liquids (e.g., ink of different colors such as Black, Yellow, and the like); however, the liquid to be ejected may be only a single kind of liquid (e.g. only Black ink, only Yellow ink, or the like). Further, the liquid is not limited to an ink, and may be any given liquid (e.g., a pretreatment liquid).

The energy applier is not limited to piezoelectric type adopting a piezoelectric element, and other type of energy applier may be adoptable (a thermal type adopting a heater element, an electrostatic type utilizing electrostatic force).

A recording apparatus related to the present invention is not limited to an inkjet type, and may be a laser type, a thermal transfer type, and the like.

The recording medium is not limited to a paper sheet. For example, in an intermediate transfer type, the recording medium is an intermediate transfer member (roller, belt, and the like).

Figure 7:
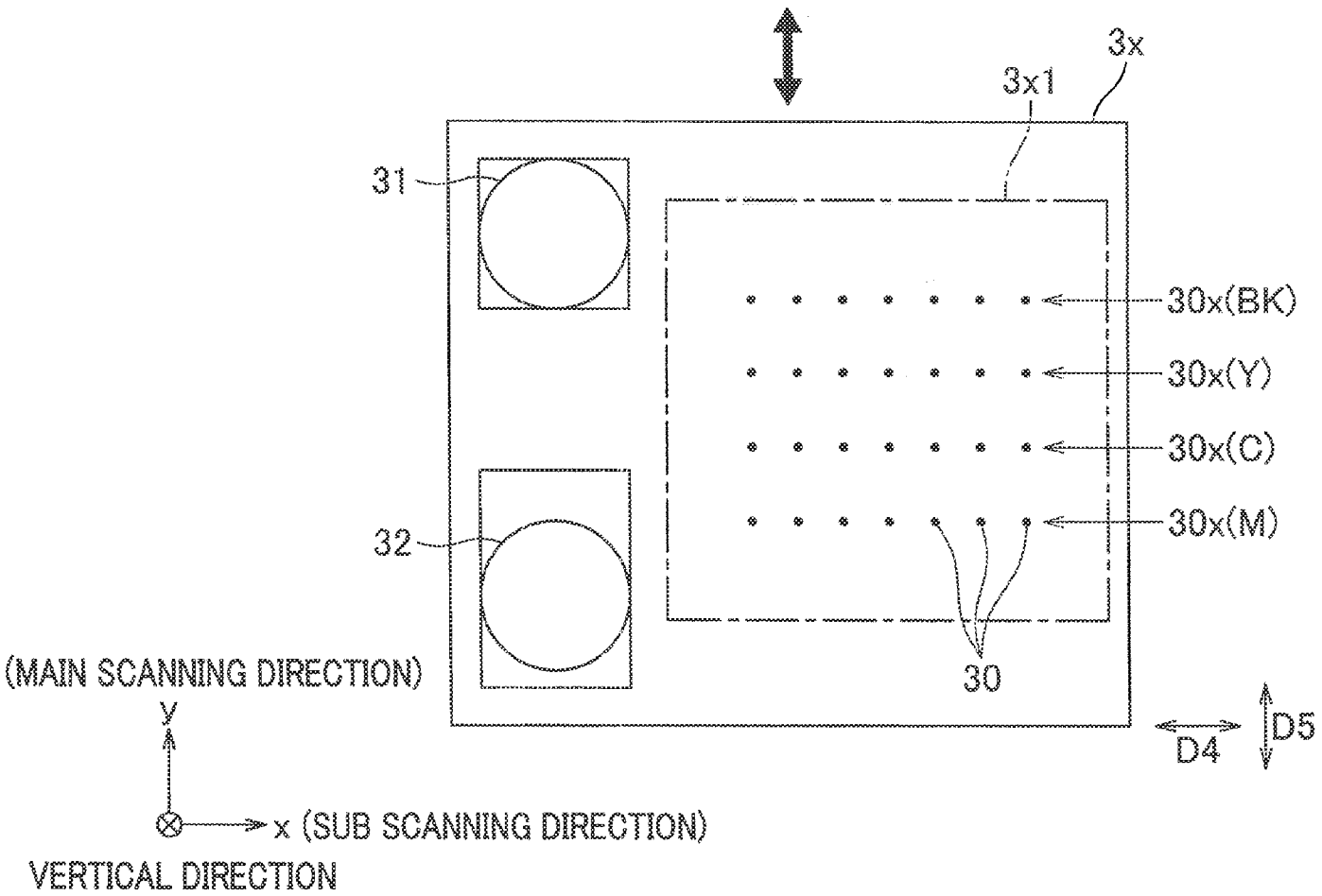
FIG. 7 is a diagram showing an exemplary application of the present invention to a serial inkjet printer.

The recording apparatus of the present invention is not limited to a line type, and may be a serial type. When adopting the present invention to a serial inkjet printer, it is possible to adopt a structure as shown in, for example, FIG. 7, and adjust the head units 3*x* by using the cams 31 and 32. In the example shown in FIG. 7, the printer includes a single head unit 3*x*, and the head unit 3*x* ejects ink from its ejection openings 30 while moving in the main scanning direction, thereby recording an image on a sheet P.

The recording apparatus of the present invention is not limited to a printer, and may be a facsimile, a photocopier, and the like.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. A recording apparatus, comprising:

a recording unit configured to record an image on a recording medium, which includes an opposing face to face the recording medium at a time of recording an image on the recording medium;

a first adjuster configured to rotate a first position and a second position different from the first position, about a first axis perpendicular to the opposing face, the first and second positions being defined on the recording unit; and a second adjuster configured to rotate the first position and the second position about a second axis, different from the first axis, perpendicular to the opposing face;

wherein, where a third direction is a direction perpendicular to a line jointing the first position and the second position:

a is an amount of travelling of the first position in the third direction, caused by the first adjuster;

b is an amount of travelling of the second position in the third direction, caused by the first adjuster;

c is an amount of travelling of the first position in the third direction, caused by the second adjuster;

d is an amount of travelling of the second position in the third direction, caused by the second adjuster; and $ad-bc \neq 0$.

2. The recording apparatus according to claim 1;

wherein a first direction which is a tangential direction to rotation of the first position about the first axis, and a second direction which is a tangential direction to rotation of the second position about the second axis each includes a component of direction parallel to the opposing face and perpendicular to a direction in which the recording unit and the recording medium move relatively to each other at a time of recording an image on the recording medium.

3. The recording apparatus according to claim 1;

wherein the first adjuster and the second adjuster each includes a cam which rotates about an axis perpendicular to the opposing face.

4. The recording apparatus according to claim 3;

wherein the cam of the first adjuster and the cam of the second adjuster have the same structure and the same size.

5. The recording apparatus according to claim 3;

wherein a rotation center of the cam of the first adjuster corresponds to the second axis; and wherein a rotation center of the cam of the second adjuster corresponds to the first axis.

6. The recording apparatus according to claim 1;

wherein the opposing face includes a plurality of ejection openings from which a liquid is ejected;

wherein the ejection openings are aligned in a fourth direction parallel to the opposing face to structure an ejection opening array; and wherein a first direction which is a tangential direction to rotation of the first position, and a second direction which is a tangential direction to rotation of the second position each includes a component of the fourth direction.

7. The recording apparatus according to claim 6;

wherein the recording unit is configured so that its position relative to a direction about its axis perpendicular to the opposing face, and relative to the fourth direction is adjusted by rotating the first position and the second position with a use of the first adjuster and the second adjuster; and wherein the apparatus further comprises a control unit configured to control an ejection timing of a liquid from ejection openings, based on position information of the ejection openings relative to a fifth direction parallel to the opposing face and perpendicular to the fourth direction.

8. The recording apparatus according to claim 6;

wherein the ejection opening array and at least another ejection opening array are aligned in a fifth direction parallel to the opposing face and perpendicular to the fourth direction; and wherein the first adjuster and the second adjuster are disposed in such a manner as to sandwich the ejection openings relative to the fifth direction.

9. The recording apparatus according to claim 1, further comprising:

at least another recording unit;

wherein the recording unit and said another recording unit are aligned in a sixth direction, the sixth direction being parallel to the opposing face and crossing a direction in which the recording units and the recording medium move relatively to each other at a time of recording an image on the recording medium;

wherein in each of the recording units, a first direction which is a tangential direction to rotation of the first position and a second direction which is a tangential direction to rotation of the second position each includes a component of the sixth direction; and wherein the first adjuster and the second adjuster are provided for each of the recording units.

10. A method of adjusting a position of a recording unit in a recording apparatus;

wherein the recording apparatus includes:

a recording unit configured to record an image on a recording medium, which includes an opposing face to face the recording medium at a time of recording an image on the recording medium;

a first adjuster configured to rotate a first position and a second position different from the first position, about a first axis perpendicular to the opposing face, the first and second positions being defined on the recording unit; and a second adjuster configured to rotate the first position and the second position about a second axis, different from the first axis, perpendicular to the opposing face;

wherein the method comprises:

a first process of measuring a relative position which is a position of the recording unit relative to a position where the recording unit should be disposed in the recording apparatus;

a second process of after the first process, determining a target travel amount relative to a direction parallel to the opposing face of the recording unit, based on the relative position measured in the first process;

a third process of after the first process, determining a first operation quantity which is an operation quantity of the first adjuster, and a second operation quantity which is an operation quantity of the second adjuster, based on the target travel amount determined in the second process; and a fourth process of after the third process, operating the first adjuster and the second adjuster based on the first operation quantity and the second operation quantity, to cause the recording unit to move in the direction parallel to the opposing face by the target travel amount; and wherein, in the recording apparatus, where a third direction is a direction perpendicular to a line jointing the first position and the second position:

a is an amount of travelling of the first position in the third direction, caused by the first adjuster;

b is an amount of travelling of the second position in the third direction, caused by the first adjuster;

c is an amount of travelling of the first position in the third direction, caused by the second adjuster;

d is an amount of travelling of the second position in the third direction, caused by the second adjuster; and $ad-bc \neq 0$.

11. The method according to claim 10;

wherein in the third process, the first operation quantity is determined based on an amount of travelling of the first position and that of the second position at a time of operating the first adjuster, and the second operation quantity is determined based on an amount of travelling of the first position and that of the second position at a time of operating the second adjuster.

12. The method according to claim 10;

wherein a first direction which is a tangential direction to rotation of the first position about the first axis, and a second direction which is a tangential direction to rotation of the second position about the second axis each includes a component of direction parallel to the opposing face and perpendicular to a direction in which the recording unit and the recording medium move relatively to each other at a time of recording an image on the recording medium.

13. The method according to claim 10;

wherein the first adjuster and the second adjuster each includes a cam which rotates about an axis perpendicular to the opposing face.

14. The method according to claim 13;

wherein the cam of the first adjuster and the cam of the second adjuster have the same structure and the same size.

15. The recording apparatus according to claim 13;

wherein a rotation center of the cam of the first adjuster corresponds to the second axis; and wherein a rotation center of the cam of the second adjuster corresponds to the first axis.

16. The method according to claim 10;

wherein the opposing face includes a plurality of ejection openings from which a liquid is ejected;

wherein the ejection openings are aligned in a fourth direction parallel to the opposing face to structure an ejection opening array; and wherein a first direction which is a tangential direction to rotation of the first position, and a second direction which is a tangential direction to rotation of the second position each includes a component of the fourth direction.

17. The method according to claim 16;

wherein the recording unit is configured so that its position relative to a direction about its axis perpendicular to the opposing face, and relative to the fourth direction is adjusted by rotating the first position and the second position with a use of the first adjuster and the second adjuster; and wherein the apparatus further comprises a control unit configured to control an ejection timing of a liquid from ejection openings, based on position information of the ejection openings relative to a fifth direction parallel to the opposing face and perpendicular to the fourth direction.

18. The method according to claim 16;

wherein the ejection opening array and at least another ejection opening array are aligned in a fifth direction parallel to the opposing face and perpendicular to the fourth direction; and wherein the first adjuster and the second adjuster are disposed in such a manner as to sandwich the ejection openings relative to the fifth direction.

19. The method according to claim 10;

wherein the recording apparatus further includes at least another recording unit and the recording unit and said another recording unit are aligned in a sixth direction, the sixth direction being parallel to the opposing face and crossing a direction in which the recording units and the recording medium move relatively to each other at a time of recording an image on the recording medium;

wherein in each of the recording units, a first direction which is a tangential direction to rotation of the first position and a second direction which is a tangential direction to rotation of the second position each includes a component of the sixth direction;

wherein the first adjuster and the second adjuster are provided for each of the recording units; and wherein the first to fourth processes are performed for each of the recording units.

* * * * *